United States Patent [19]

Bordelon et al.

[11] 4,258,234

[45] Mar. 24, 1981

[54] ELECTROACOUSTIC DEVICE

[75] Inventors: Chester M. Bordelon, Shreveport, La.; Richard C. Sherwood, New Providence, N.J.

[73] Assignees: Western Electric Incorporated, New York, N.Y.; Bell Telephone Laboratories Incorporated, Murray Hill, N.J.

[21] Appl. No.: 69,276

[22] Filed: Aug. 24, 1979

[51] Int. Cl.[3] ..... H04R 13/02

[52] U.S. Cl. ..... 179/114 R

[58] Field of Search ..... 179/117, 118, 119, 120, 179/114 R; 335/234, 278, 279, 302; 75/126 R, 126 H, 170; 148/108, 120, 31.57, 121, 100, 101, 31.55

[56] References Cited

U.S. PATENT DOCUMENTS

| | | | |
|---|---|---|---|
| 2,506,624 | 5/1950 | Wirsching | 179/120 |
| 4,075,437 | 2/1978 | Chin et al. | 179/114 R |

OTHER PUBLICATIONS

"*Ferromagnetism*", by Bozorth, Van Nostrand, 1959, pp. 210–220.

"*Permanent Magnets and Their Application*", Parker et al., Wiley, 1962, pp. 60–61, 154.

"*The Ring Armature Telephone Receiver*", Mott et al., BSTJ vol. 50, Jan. 1951, pp. 110–140.

"*Study of Heat Treatments for Low Coercive Force 14 to 17% Aluminum Iron Alloys*", J. Appl. Phys., Supp. vol. 31, No. 5, May 1960, Pavlovic et al., pp. 231S–232S.

"*Recent Developments in Soft Magnetic Alloys*", Adams, J. Appl. Phys., Supp. vol. 33, No. 3, Mar. 1962, pp. 1214–1220.

"*Sendust Sheet-Processing Techniques and Magnetic Properties*", Helms, Jr., J. Appl. Phys., vol. 35, No. 3, Mar. 1964, pp. 871–872.

"*Magnetic Properties of Oriented 3 Percent Aluminum Iron Sheets*", Foster et al., J. Appl. Phys., vol. 34, No. 4, (Part 2), Apr. 1963, pp. 1325–1326.

"*Alloys with Low Remanence and Low Coercive Force in the Region of 9% Aluminum Iron*", Pavlovic et al., J. Appl. Phys., vol. 36, No. 3, Mar. 1965, pp. 1237–1239.

*Primary Examiner*—Thomas A. Robinson

*Attorney, Agent, or Firm*—Peter A. Businger

[57] ABSTRACT

Electroacoustic devices are disclosed which comprise a permanent magnet and a magnetically permeable component. The permanent magnet is made of an Fe-Cr-Co alloy comprising 20–40 weight percent Cr and 3–30 weight percent Co; the permeable component is made of an Fe-Al alloy comprising 1.5–18 weight percent Al.

In addition to a magnetic circuit, disclosed devices comprise means such as, e.g., an induction coil for inducing a variable magnetic field in the magnetic circuit. Also, devices comprise means for utilizing energy output in response to the magnetic field. Energy output may typically be in the form of an acoustical signal having desirably flat frequency response. Due to their low cost, disclosed devices are particularly suitable for use in telephone receivers and other mass produced articles.

6 Claims, 2 Drawing Figures

ELECTROACOUSTIC DEVICE

CROSS-REFERENCE TO RELATED APPLICATIONS

Concurrently filed are patent applications Ser. No. 069,277 and Ser. No. 069,278.

TECHNICAL FIELD

The invention is concerned with devices comprising magnetic components in a magnetic circuit.

BACKGROUND OF THE INVENTION

Electroacoustic devices are employed, e.g., as microphones, loudspeakers, and telephone receivers and may be designed in a variety of ways. For example, so-called ring armature electroacoustic transducers comprise an annular permanent magnet, and an annular, magnetically permeable component known as a pole piece which complements the permanent magnet to a magnetic circuit having an air gap. An induction coil is in proximity of the permeable component and a diaphragm is physically attached to a magnetic element in the air gap. Such design is disclosed, e.g., in U.S. Pat. No. 2,506,624, "Electroacoustic Transducer", issued May 9, 1950, to R. E. Wirsching and also on p. 111 and p. 124 of the paper by E. E. Mott et al., "The Ring Armature Telephone Receiver", *Bell System Technical Journal,* Vol. 50, January 1951, pp. 110–140. The latter reference, on p. 112, further discloses three alternate transducer designs, two of which have axially symmetrical design similar to the ring armature transducer. Design of an electroacoustic transducer typically involves consideration of a variety of design parameters such as, e.g., choice of an appropriate combination of permanent magnet and permeable components. In this respect, certain alloy combinations have become established such as, in particular, combinations of Permalloy with either Remalloy or Alnico. The latter two alloys are mentioned e.g., in the book by R. J. Parker et al., *Permanent Magnets and Their Application,* Wiley, 1962.

Relevant with respect to the invention is a line of development which is concerned with Fe-Cr-Co alloys and their properties. Such alloys are disclosed in various publications and patents such as, e.g., U.S. Pat. No. 4,075,437, "Composition, Processing and Devices Including Magnetic Alloy", issued Feb. 21, 1978, to G. Y. Chin et al., U.S. Pat. No. 4,174,983, issued Nov. 20, 1979 to G. Y. Chin et al. U.S. patent application Ser. No. 924,138, filed July 13, 1978 (now abandoned in favor of continuation application Ser. No. 092,941), U.S. patent application Ser. No. 016,115, filed Feb. 28, 1979, and concurrently filed U.S. patent applications Ser. No. 069,277 and Ser. No. 069,278.

Relevant with respect to the invention is another line of development which is concerned with Fe-Al alloys and their properties. In particular, the paper D. Pavlovic et. al., "Study of Heat Treatments for Low Coercive Force 14 to 17 Percent Aluminum Iron Alloys", *J. App. Phys.,* Supp. Vol. 31, No. 5, May 1960, pp. 231S–232S which is concerned with the influence of processing parameters on the coercive force of Fe-Al alloys containing 14–17 weight percent Al and, optionally, small ternary additions. A comparison of various magnetically soft alloys is made by E. Adams, "Recent Developments in Soft Magnetic Alloys", *J. App. Phys.,* Supp. Vol. 33, No. 3, March 1962, pp. 1214–1220. Among alloys considered by Adams is a Si-Al-Fe alloy which is designated Sendust and which is also investigated in the paper by H. H. Helms, "Sendust Sheet-Processing Techniques and Magnetic Properties", *J. App. Phys.,* Vol. 35, No. 3, March 1964, pp. 871–872. Fe-Al alloys containing 3 percent and 9 percent aluminum are considered, respectively, in the paper by K. Foster et al., "Magnetic Properties of Oriented 3 Percent Aluminum Iron Sheets", *J. App. Phys.,* Vol. 34, No. 4 (Part 2), April 1963, pp. 1325–1326 and in the paper by D. Pavlovic et al., "Alloys with Low Remanence and Low Coercive Force in the Region of 9 Percent Aluminum Iron", *J. App. Phys.,* Vol. 36, No. 3, pp. 1237–1239. Fe-Al alloys are also mentioned in the book by R. M. Bozorth, *Ferromagnetism,* Van Nostrand, 1951, pp. 210–220.

SUMMARY OF THE INVENTION

Certain Fe-Al alloys have been found to be suited as high-permeability components in inductive devices in combination with Fe-Cr-Co permanent magnets. In particular, devices comprise a magnetic circuit comprising an Fe-Cr-Co alloy component comprising Cr in an amount in a preferred range of 20–40 weight percent, Co in an amount in a preferred range of 3–30 weight percent and, possibly, fourth element additions such as, e.g., Cu or Ni in amounts preferably not exceeding 5 weight percent. The device further comprises an Fe-Al component which is magnetically biased by the Fe-Cr-Co magnet component and which comprises Al in an amount in a range of 1.5–18 weight percent. Devices of the invention have desirably flat frequency response in the acoustic range.

DETAILED DESCRIPTION

Figure 1:
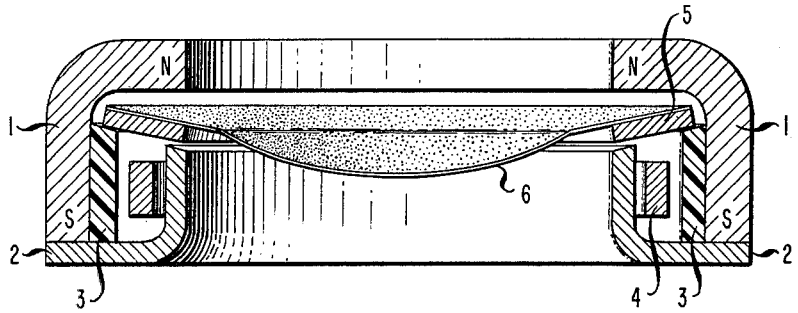
FIG. 1 shows, in cross section, a telephone receiver comprising magnetic components according to the invention.

FIG. 1 shows, in cross section, a telephone receiver comprising permanent magnet 1, pole piece 2, support 3, induction coil 4, ring armature 5 which is in an air gap in the magnetic circuit formed by magnet 1 and pole piece 2 and which is held against support 3 by a magnetic field produced by magnet 1. Diaphragm 6 is attached to ring armature 5. Upon application of a suitable AC signal to induction coil 4, membrane 6 vibrates and transmits acoustic energy to the ambient.

When permanent magnet 1 and pole piece 2 are made of preferred alloys, the device shown in FIG. 1 is a preferred embodiment according to the invention. Preferred alloys for magnet 1 are Fe-Cr-Co alloys comprising an amount of at least 90 and preferably at least 95 weight percent Fe, Cr, and Co. Preferred amounts of alloy constituents are 20–40 weight percent Cr and 3–30 weight percent Co. In the absence of significant amounts of fourth element additives, preferred amounts are 25–29 weight percent Cr and 7–12 weight percent Co as disclosed in U.S. patent application Ser. No. 016,115 cited above. Cu and Ni are preferred additives as disclosed, respectively, in U.S. patent applications Ser. No. 69,277 and Ser. No. 69,278.

Preferred alloys for pole piece 2 are Fe-Al alloys comprising an amount of at least 95 and preferably at least 98 weight percent Fe and Al. Amounts of alloy constituents are 1.5–18 weight percent Al, amounts in a more narrow preferred range of 2–10 weight percent being particularly suited on account of high permeability and formability in resulting alloys.

Combination of alloys according to the invention is believed to be particularly suited in the manufacture of telephone receivers and, generally, in electroacoustic devices comprising a magnetic circuit comprising a biasing magnet and a permeable component. Magnet and permeable components preferably have volumes of at least 10 percent of the combined volumes of the two components.

A magnetic circuit may be shaped as desired, e.g., according to receiver design shown in FIG. 1, according to alternate receiver designs shown in the paper by Mott et al. cited above, or according to alternate magnet and pole piece arrangements shown on p. 512 of the book by Parker cited above.

In addition to a magnetic circuit as described above, devices of the invention comprise means for inducing a variable magnetic field in the magnetic circuit and means for utilizing energy output. A variable magnetic field may be induced, e.g., by an additional movable magnet or by a magnetic induction coil. Energy is typically utilized acoustically, e.g., by means of a diaphragm which is attached to an armature which, at least in part, is in an air gap in the magnetic circuit.

Manufacture of Fe-Cr-Co and Fe-Al magnetic components is well documented in the metallurgical literature. Both alloys have acceptable levels of formability as disclosed, respectively, in U.S. Pat. No. 4,075,437 cited above and the paper by Foster cited above.

Preparation of Fe-Al alloys from a melt is preferably carried out in a vacuum to minimize oxidation. Melts are conveniently prepared by induction melting to minimize segregation. Shaped articles may be conveniently obtained from cast ingots by conventional processing of hot working, cold rolling, annealing, cold rolling and shaping, and annealing. Shaping may involve methods such as drawing, deep drawing, stamping, and bending.

EXAMPLE

Figure 2:
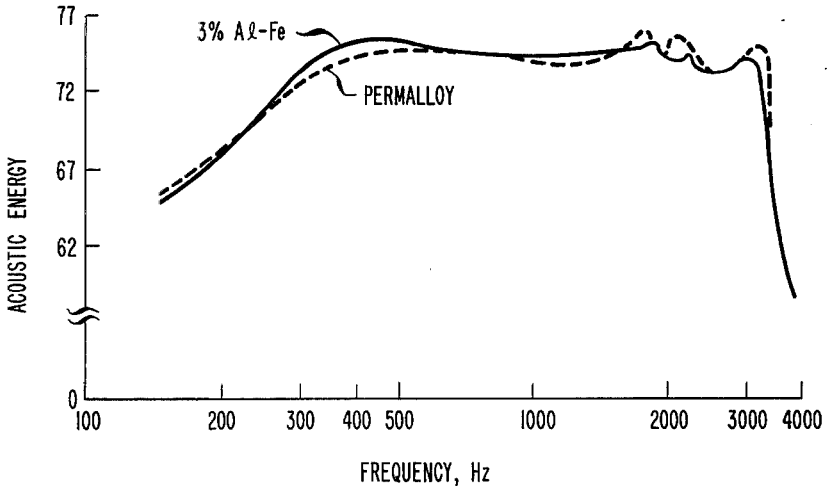
FIG. 2 shows functional relationship between frequency and acoustic energy as realized in a receiver according to the invention and as depicted in FIG. 1, and as compared with a prior art receiver. Energy units are as indicated on calibrated test apparatus and are used for comparison purposes.

A telephone receiver as depicted in FIG. 1 was equipped with a permanent magnet 1 made of an alloy containing 28 weight percent Cr, 10.5 weight percent Co, and remainder Fe. Pole piece 2 was made of an alloy containing 3 weight percent Al and remainder Fe. The resulting receiver was subjected to a standard test under controlled conditions to determine frequency response, i.e., acoustic energy output as a function of frequency upon application of a constant energy, variable frequency electrical signal to coil 4. The test consisted in placing the receiver on a 6 $cm^3$ cavity, applying an 81 mV sinusoidal signal to the receiver coil from a source having 150 ohm impedance, and measuring energy output as a function of signal frequency. FIG. 2 graphically depicts measured response of the new receiver as well as measured response of a receiver equipped with a Permalloy pole piece. It can be seen from FIG. 2 that frequency response of the new device closely matches that of the prior art device and that, in fact, frequency response of the new device is more nearly constant as is desired in the range of 600–3300 Hz.

We claim:

1. Device comprising a magnetic circuit comprising (1) a first magnetic component which is magnetized in a preferred direction, (2) a second magnetic component whose magnetic coercivity is less than the magnetic coercivity of said first component and which is magnetically biased by said first component, (3) first means for inducing a variable magnetic field in said circuit, and (4) second means for utilizing energy output, characterized in that (a) said first component consists essentially of a first alloy which comprises a first amount which comprises at least 90 weight percent of said alloy and which consists of Fe, Cr, and Co, Cr being present in said first alloy in an amount in the range of 20–40 weight percent of said first amount and Co being present in said first alloy in an amount in the range of 3–30 weight percent of said first amount, and (b) said second component consists essentially of a second alloy which comprises a second amount which comprises at least 95 weight percent of said alloy and which consists of Fe and Al, Al being present in said second alloy in an amount in the range of 1.5–18 weight percent of said second amount.

2. Device of claim 1 in which said second component has a volume which is at least 10 percent of the combined volume of said first and said second component and in which said first component has a volume which is at least 10 percent of said combined volume.

3. Device of claim 1 in which said first alloy is an essentially ternary alloy, Cr being present in said alloy in an amount in the range of 25–29 weight percent of said first alloy and Co being present in said first alloy in an amount in the range of 7–12 weight percent of said first alloy.

4. Device of claim 1 in which Al is present in said second alloy in an amount in the range of 2–10 weight percent of said second amount.

5. Device of claim 1 in which said second means comprises a third magnetic component which, at least in part, is in said air gap.

6. Device of claim 5 in which an acoustic diaphragm is attached to said third magnetic component.

* * * * *